United States Patent [19]

Okano et al.

[11] 4,409,310

[45] * Oct. 11, 1983

[54] SURFACE DOPED INORGANIC ELECTROPHOTOGRAPHIC PHOTOSENSITIVE PARTICLES IN BINDER

[75] Inventors: Kazumi Okano, Fuchu; Yuji Nishigaki, Yokohama; Masanao Kasai, Tokyo, all of Japan

[73] Assignee: Canon Kabushiki Kaisha, Tokyo, Japan

[ * ] Notice: The portion of the term of this patent subsequent to Feb. 23, 1999 has been disclaimed.

[21] Appl. No.: 349,657

[22] Filed: Feb. 17, 1982

Related U.S. Application Data

[63] Continuation of Ser. No. 188,122, Sep. 17, 1980, abandoned.

[30] Foreign Application Priority Data

Sep. 20, 1979 [JP] Japan ..... 54-121504

[51] Int. Cl.[3] ..... G03G 5/087; G03G 5/09

[52] U.S. Cl. ..... 430/95; 430/89; 430/90; 430/94; 252/501.1

[58] Field of Search ..... 430/84, 89, 90, 94, 430/95, 901; 252/501.1

[56] References Cited

U.S. PATENT DOCUMENTS

| | | | |
|---|---|---|---|
| 3,486,889 | 11/1969 | Bobalek et al. . | |
| 3,634,333 | 1/1972 | Tamai | 252/501.1 |
| 4,043,813 | 8/1977 | Logue et al. | 430/90 X |
| 4,183,748 | 1/1980 | Murai et al. | 430/135 |
| 4,316,948 | 2/1982 | Nishigaki et al. | 430/94 |

FOREIGN PATENT DOCUMENTS

| | | | |
|---|---|---|---|
| 1005246 | 9/1965 | United Kingdom | 430/89 |
| 1031864 | 6/1966 | United Kingdom | 430/95 |
| 1215685 | 12/1970 | United Kingdom | 430/89 |

*Primary Examiner*—Roland E. Martin, Jr.

*Attorney, Agent, or Firm*—Fitzpatrick, Cella, Harper & Scinto

[57] ABSTRACT

The electrophotographic photosensitive member has a photoconductive layer containing photoconductive particles each of which has a water insoluble compound of a metal element of Group VIII of the Periodic Table deposited on the surface.

5 Claims, 1 Drawing Figure

SURFACE DOPED INORGANIC ELECTROPHOTOGRAPHIC PHOTOSENSITIVE PARTICLES IN BINDER

This is a continuation of application Ser. No. 188,122, filed Sept. 17, 1980, now abandoned.

BACKGROUND OF THE INVENTION

Field of the Invention

In the techniques of electrophotographic photosensitive members, the maximum value of ratio of the change of the a surface potential ($\Delta V$) to the change of exposure E (hereinafter represented by $\Delta$ log E) is very important. This maximum value is called $\gamma$ value. The above-mentioned relation is represented by the following formula.

$$|\Delta V/\Delta \log E|_{max}=\gamma$$

The $\gamma$ value has a great effect on the reproducibility of original information during latent image formation in electrophotographic processes. That is, where $\gamma$ value of a photosensitive member is very high, the resulting latent images are very unstable since the surface potential is very sensitive to even a minor change of exposure and, in particular, latent images corresponding to a light of intermediate intensity are so unstable that the developed images can not contain any half tone (grey) and are of low gradation.

On the contrary, where $\gamma$ value is too small, fog is formed and good images can not be obtained. In general, $\gamma$ value is controlled by doping with impurities such as Cu, Cl, In and the like and adjusting the particle size of photoconductive particles in a photoconductive layer. However, such procedures do not always give a satisfactory result.

In addition, in the case of an electrophotographic photosensitive member having a photoconductive layer containing photoconductive particles, the $\gamma$ value usually tends to increase during repeated use and the rate of change of $\gamma$-value is a main factor to estimate durability of a photosensitive member.

At present, production of photosensitive members of a low change rate of $\gamma$ value is a big problem to be solved.

SUMMARY OF THE INVENTION

An object of the present invention is to provide an electrophotographic photosensitive member having a desired $\gamma$ value.

Another object of the present invention is to provide an electrophotographic photosensitive member having a small change rate of $\gamma$ value.

According to the present invention, there is provided an electrophotographic photosensitive member which comprises a photoconductive layer containing inorganic photoconductive particles on the surface of which a water insoluble compound of a metal element of Group VIII of the Periodic Table is deposited.

DESCRIPTION OF THE PREFERRED EMBODIMENTS

Figure 1:
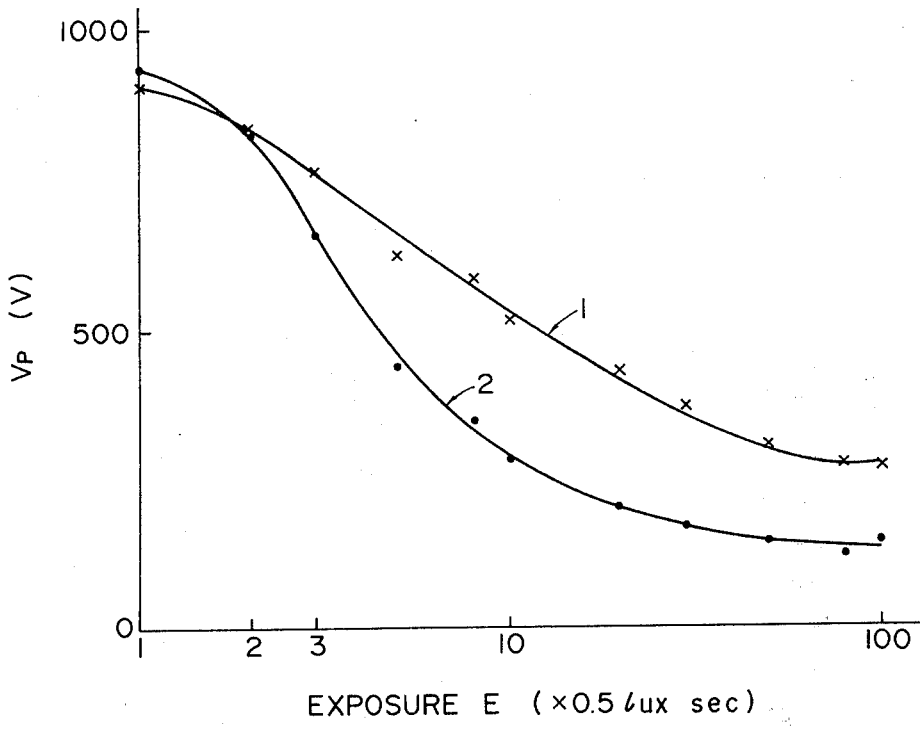
FIG. 1 is a graph showing a sensitivity curve of a photosensitive member according to the present invention.

According to the present invention, the $\gamma$ value can be optionally controlled by changing the deposition amount of the water insoluble metal compound.

Since the $\gamma$ value can be finally adjusted by depositing the water insoluble compound on the surface of photoconductive particles, a wide range of photoconductive materials can be selected for each particular purpose or use even if the $\gamma$ value of the selected photoconductive or particle itself is not appropriate.

The electrophotographic photosensitive member prepared by using photoconductive particles on which an insoluble compound of a metal element of Group VIII of the Periodic Table is deposited exhibits advantageously only a small change of $\gamma$ value upon repeated use.

Preferable elements of Group VIII of the Periodic Table are Fe, Co, Ni and the like.

As a water insoluble compound of the element of Group VIII of the Periodic Table, there may be mentioned hydroxides such as $Fe(OH)_3$, $Co(OH)_2$, $Ni(OH)_2$ and the like, and sulfides such as $Fe_2S_3$, $Co_2S_3$, NiS and the like.

Amount of the water insoluble compound deposited on the photoconductive particles may be optionally selected. It is usually 0.01–1 weight part, preferably 0.1–0.5 weight part per 100 weight parts of photoconductive particles.

Representative constructions of the electrophotographic photosensitive member according to the present invention are a member composed of a substrate and a photoconductive layer overlying the substrate and a member similar to the above mentioned member except that an insulating layer overlies the photoconductive layer.

As the substrate, there may be used conductive substrates such as metals and their alloys. Examples of the metal are stainless steel, Al, Cr, Mo, Au, In, Nb, Ta, V, Ti, Pt, Pd and the like. There may be also used insulating substrates such as glass, synthetic resin films and the like. For example, in case of glass, its surface is conductivized with $In_2O_3$, $SnO_2$ or the like, and in case of a synthetic resin film such as polyamide film, its surface is conductivized by means of vacuum vapor deposition, electron beam deposition, sputtering and the like with a metal such as Al, Ag, Pb, Zn, Ni, Au, Cr, Mo, Ir, Nb, Ta, V, Ti, Pt and the like, or by laminating the metal film to the surface.

The photoconductive layer is usually produced by dispersing photoconductive particles in a binder.

As the binder, various insulating resins may be optionally used. For example, there are used polyethylene, polyester, polypropylene, polystyrene, polyvinyl chloride, polyvinyl acetate, acrylic resins, polycarbonate, silicone resins, fluorocarbon resins, and epoxy resins.

When carbonization of resins is utilized for lowering the electric resistance, there may be preferably used the resins such as vinyl chloride-vinyl acetate copolymer, polyvinyl butyral, vinyl chloride-vinylidene chloride copolymer, acrylic resins, polystyrene-butadiene copolymer and the like.

As the organic photoconductive particles, there may be used oxides, sulfides, iodides, selenides and the like of a metal such as Zn, Hg, Al, Sb, Bi, Cd, Mo and the like. They are, for example, zinc oxide, cadmium sulfide, zinc sulfide, cadmium selenide, lead oxide, arsenic sulfide, titaium oxide, zinc titanium oxide, zinc silicon oxide, zinc magnesium oxide, mercury iodide, mercury oxide, mercury sulfide, indium sulfide, and calcium strontium sulfide.

Amount of a binder for forming a photoconductive layer is usually 0.5–50 weight parts, preferably 5–20 weight parts, per 100 parts of photoconductive particles.

Thickness of the photoconductive layer varies depending upon type and characteristics of the photoconductive layer. It is usually 5–100 microns, preferably 10–50 microns.

As to a photosensitive member provided with an insulating layer, various resins are optionally used for forming the insulating layer. For example, there are used polyethylene, polyester, polypropylene, polystyrene, polyvinyl chloride, polyvinyl acetate, acrylic resins, polycarbonate, silicone resins, fluorocarbon resins, and epoxy resins. Thickness of the insulating layer is usually 0.1–100 microns, preferably 0.1–50 microns.

EXAMPLE 1

0.049 g of ferric chloride and 350 cc of pure water were placed in a 500 cc beaker and the ferric chloride was completely dissolved in the water. 30 g of photoconductive CdS particles were added to the beaker and 30 cc of 0.06 N aqueous ammonia was then slowly added thereto with stirring by a magnetic stirrer to precipitate ferric hydroxide simultaneously with depositing it on the surface of the photoconductive CdS particles. After stirring for an additional 5 min., the photoconductive CdS particles thus treated were washed with water twice by decantation, filtered, and dried at 70° C. for 24 hours.

20 g of the resulting photoconductive CdS particles was dispersed in 12 g of vinyl chloride-vinyl acetate copolymer diluted with butytl acetate by a roll-mill. The resulting mixture was applied to an aluminum foil (50 microns thick) in the thickness of 40 microns by means of knife-coating to produce a photoconductive layer. To the resulting photoconductive layer was adhered a transparent polyethylene terephthalate film (25 microns thick) with an adhesive of 8 microns thick as an insulating layer to produce a three-layered electrophotographic photosensitive plate. Then the sensitivity curve of the resulting plate was measured.

The measurement was conducted as shown below. A glass plate having a transparent electrode was pressed onto the surface of the insulating layer of the photosensitive plate and connected with a high voltage DC power source through a relay to apply 2000 V (Va) simultaneously with irradiation of a light of E lux for 0.2 sec by a halogen lamp. After 0.2 sec, a blanket exposure was effected for 0.2 sec and then after 1 sec, the surface potential (Vp') was measured by measuring a metal plate of the same voltage as that of the sample by means of a surface potentiometer.

When Va was −2000 V and illumination E was varied in the range of 0–250 lux, the resulting Vp (=Va−Vp') was shown by curve 1 in FIG. 1. Vp is a voltage applied to the photoconductive layer. $\gamma$ value calculated from this curve was about 460.

For comparison, photoconductive CdS on which ferric hydroxide was not deposited was used to produce a photosensitive plate and its sensitivity curve was measured. The curve was as shown by curve 2 in FIG. 1. The $\gamma$ value was about 1200.

EXAMPLE 2

| | |
|---|---|
| Photoconductive CdS particles | 30 g |
| $FeCl_3$ | 0.098 g |

By using the above ingredients, the procedures of Example 1 were repeated except that 50 cc of 0.06 N aqueous $Na_2S$ was used in place of aqueous ammonia, and $Fe_2S_3$ was deposited on the surface of the photoconductive CdS particles and dried at 70° C. for 24 hours. The resulting photoconductive CdS was made into a photosensitive plate following the procedure of Example 1. The $\gamma$ value was about 400.

EXAMPLE 3

| | |
|---|---|
| Photoconductive CdS particles | 30 g |
| $NiCl_2$ | 0.039 g |

By using the above ingredients, the procedures of Example 1 were repeated except that 50 cc of 0.06 N aqueous NaOH was used in place of aqueous ammonia, and $Ni(OH)_2$ was deposited on the surface of the photoconductive CdS particles and dried at 70° C. for 24 hours. The resulting photoconductive CdS was used for producing a photosensitive plate following the procedure of Example 1. The $\gamma$ value was about 600.

EXAMPLE 4

| | |
|---|---|
| Photoconductive ZnO particles | 50 g |
| $FeCl_3$ | 0.098 g |
| 0.06N aqueous ammonia | 30 cc |

The procedures of Example 1 were repeated by using the above ingredients, that is, photoconductive ZnO particles and 0.098 g of $FeCl_3$ were used here in place of photoconductive CdS particles and 0.049 g of $FeCl_3$ in Example 1, respectively, to deposit $Fe(OH)_3$ on the surface of the photoconductive ZnO particles followed by drying at 70° C. for 24 hours.

A photosensitive member prepared by using the resulting photoconductive ZnO exhibited good reproducibility of half tone.

EXAMPLE 5

| | |
|---|---|
| Photoconductive ZnO particles | 50 g |
| $NiCl_2$ | 0.039 g |
| 0.06N aqueous NaOH | 50 cc |

By using the above ingredients, the procedures of Example 3 were repeated, that is, photoconductive ZnO particles were used in place of photoconductive CdS particles in Example 3, to deposit $Ni(OH)_2$ on the surface of the photoconductive ZnO particles followed by drying at 70° C. for 24 hours. A photosensitive member prepared by using the resulting photoconductive ZnO exhibited good reproducibility of half tone.

What we claim is:

1. An electrophotographic photosensitive member which comprises a photoconductive layer comprising a binder having dispersed therein inorganic photoconductive particles on the surface of which a water insoluble compound of a metal element of Group VII of the Periodic Table is deposited by reacting a water soluble compound of a metal element of Group VIII of the Periodic Table with a reagent which is capable of producing said water insoluble compound in the presence of said inorganic photoconductive particles.

2. An electrophotographic photosensitive member according to claim 1 in which the metal element is selected from the group consisting of Fe, Co and Ni.

3. An electrophotographic photosensitive member according to claim 1 in which the water insoluble compound is selected from the group consisting of $Fe(OH)_3$, $Co(OH)_2$, $Ni(OH)_2$, $Fe_2S_3$, $Co_2S_3$ and NiS.

4. An electrophotographic photosensitive member according to claim 1 in which the amount of the water insoluble compound deposited on the surface of the photoconductive particles is 0.01–1 weight part per 100 weight parts of the photoconductive particles.

5. An electrophotographic photosensitive member according to claim 1 in which the water-soluble compound is a member selected from the group consisting of a metal hydroxide and a metal sulfide.

* * * * *

UNITED STATES PATENT AND TRADEMARK OFFICE

CERTIFICATE OF CORRECTION

PATENT NO. : 4,409,310

DATED : October 11, 1983

INVENTOR(S) : OKANO, ET AL.

It is certified that error appears in the above-identified patent and that said Letters Patent is hereby corrected as shown below:

Col. 1, line 12, after "of" first occurrence, insert --the--.
Col. 1, line 13, before "a" delete --the--.
Col. 1, line 56, "change rate of $\gamma$ value" should be --rate of change $\gamma$ value--.
Col. 2, line 64, change "organic" to --inorganic--.
Col. 3, line 38, change "butytl" should be --butyl--.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*